United States Patent [19]

Knourek et al.

[11] 3,987,646

[45] Oct. 26, 1976

[54] MAGNETIC ACTUATOR CONSTRUCTION FOR A CIRCULAR KNITTING MACHINE

[75] Inventors: Jaroslav Knourek; Oldrich Kouril; Vladimir Mureso, all of Brno, Czechoslovakia

[73] Assignee: Vyzkumny a vyvojovy ustav Zavodu vseobecneho strojirenstvi, Brno, Czechoslovakia

[22] Filed: Nov. 20, 1974

[21] Appl. No.: 525,558

Related U.S. Application Data

[63] Continuation-in-part of Ser. No. 216,342, Jan. 10, 1972, abandoned.

[52] U.S. Cl. ..... 66/50 R; 66/154 A

[51] Int. Cl.[2] ..... D04B 15/78

[58] Field of Search ..... 66/50 R, 25, 154 A, 66/75

[56] References Cited

UNITED STATES PATENTS

| | | | |
|---|---|---|---|
| 2,809,508 | 10/1957 | McDonough | 66/123 X |
| 3,283,541 | 11/1966 | De Cerjat | 66/50 R |
| 3,365,916 | 1/1968 | Ribler et al. | 66/50 R |
| 3,518,845 | 7/1970 | De Cerjat | 66/50 R |
| 3,535,892 | 10/1970 | Schmidt et al. | 66/50 R |
| 3,605,448 | 9/1971 | Ribler | 66/50 R |
| 3,710,594 | 1/1973 | Bourgeois | 66/50 R |
| 3,771,332 | 11/1973 | Knourek et al. | 66/50 R |
| 3,855,819 | 12/1975 | Sawazaki | 66/50 R |
| 3,861,173 | 1/1975 | Kinkelin | 66/50 R |

*Primary Examiner*—Mervin Stein
*Assistant Examiner*—A. M. Falik

[57] ABSTRACT

The movement of each of a plurality jacks or rocking pressers of a ferromagnetic material a circular knitting machine between a knitting and a non-knitting position is accomplished by the cooperation of the fields of a permanent magnet and a selectively actuable electromagnet which are magnetically isolated from each other. The portion of the jack where such fields intersect may be recessed to accomplish jack positioning with minimum expenditure of magnetomotive force. The airgap in the pole structure of the permanent magnet and in the separate core of the electromagnet are coaxially disposed, with the electromagnet being suitably located either inside or outside the core of the electromagnet. Where outside mounting is used, the permanent magnet may be disposed on the periphery of the circular bed of the machine along with the jacks, while the electromagnet is radially spaced therefrom.

11 Claims, 7 Drawing Figures

INVENTORS:
JAROSLAV KNOUREK,
OLDRICH KOURIL,
VLADIMIR MURESO
BY: Arthur O. Klein
ATTORNEY

INVENTORS:
JAROSLAV KNOUREK,
OLDRICH KOURIL,
VLADIMIR MURESO

BY: Arthur O. Klein
ATTORNEY

MAGNETIC ACTUATOR CONSTRUCTION FOR A CIRCULAR KNITTING MACHINE

This application is a continuation in-part of application Ser. No. 216,342, filed Jan. 10, 1972, now abandoned.

BACKGROUND OF THE INVENTION

Conventional circular knitting machines include a rotary needle cylinder which may carry a plurality of magnetically actuable jacks or rocking pressers that transmit motion to the needles. The desired pattern to be manufactured is controlled by a coded punched tape or similar program carrier which outpulses knitting and non-knitting commands in the form of impulses to an actuating electromagnet. In the type of machine of particular interest in the instant application, the magnetic field of such electromagnet cooperates in a differential manner with that of a permanent magnet.

In this arrangement, the permanent magnet normally acts on the magnetic portions of successively engageable rocking pressers, which move close to the permanent magnet by the help of a cam. Said magnet attracts and holds such presser against a restoring force thereby situating such presser in a non-knitting position. When a knitting command is outpulsed from the coded tape, the electromagnet is actuated to weaken the attraction force of the permanent magnet so that the rocking presser can move in the direction of the restoring force to a knitting position to operate the associated needle.

In presently known arrangements of this type, such as disclosed in Ribler U.S. Pat. No. 3,605,448, the coil of the electromagnet is generally wound around one soft iron pole piece of the permanent magnet as well as around the core of the electromagnet so that the fields of the permanent magnet and the electromagnet are strongly coupled. It has been found that this scheme is highly inefficient, since the actuation of the electromagnet not only markedly weakens the magnetic field in the pole pieces of the permanent magnet but also serves to change the point of the non-linear B-H curve of the permanent magnet at which such magnet operates. The result of such change is a significant increase in the reluctance of the composite magnetic circuit of the electromagnet, the permanent magnet and the rocking presser, which in turn increases the amount of magneto-motive force necessary to support an actuating flux level in the jack. Accordingly, an unsatisfactory high degree of loading is imposed on the driving circuitry for the actuator.

SUMMARY OF THE INVENTION

Such unsatisfactory high degree of loading imposed on the driving circuitry for the actuator in presently known arrangements of the above-described type is overcome with the mounting arrangement for the actuator constructed in accordance with the invention for use, e.g., in a circular knitting machine. In general, the electromagnet is provided with a magnetic core separate and apart from the pole structure of the permanent magnet, with the pole structure and the core having individual air gaps.

The permanent magnet normally acts on the magnetic portions of successively engageable rocking pressers, which move close to the permanent magnet with the help of a cam. The permanent magnet attracts and holds such presser against the restoring force thereby situating such presser in a non-knitting position. When a knitting command is out-pulsed from the coated tape, the electromagnet is attracted to weaken the attraction force of the permanent magnet so that the rocking presser can move in the direction of the restoring force to a knitting position to operate the associated needle. The permanent magnet and the electromagnet are disposed with their air gaps mounted coaxially with respect to the line of action of the restoring force acting on the jack. The pole structure of the permanent magnet and the core of the electromagnet are spaced from each other and oriented so that their magnetic fields intersect only in a first portion of the rocking presser, while at any other point they do not affect each other.

The basic difference between FIG. 4 of the above Ribler patent and the present invention lies in that in Ribler the coils directly control the flux generated by the permanent magnet. By way of contrast, the present invention is concerned with two independent magnetic circuits, that is, the field of the permanent magnet and the field of the electromagnet, each acting on a rocking presser.

In the mechanism disclosed in the Ribler U.S. Pat. No. 3,605,448 the coils 5, 5' do not control the flux generated by the permanent magnet 1, nor would this be desirable from the functional point of view. Instead, electromagnetic flux is generated to substitute for the lacking permanent magnetic flux in the area of the air gaps 9, 9', in the area of which the very selection takes place. The principle of the Ribler mechanism differs markedly from that of the present invention wherein the magnetic flux generated by the permanent magnet keeps acting throughout the selecting action and is controlled and displaced from the controlled member by electromagnetic flux.

The resulting relatively low reluctance of each separate magnetic path through the rocking presser lowers the total magnetomotive force required to drive the actuating flux through the rocking presser. The first portion of the rocking presser may be recessed to concentrate the flux passing therethrough, to further reduce the amount of driving force required.

In a first form of the invention, the pole structure of the permanent magnet is mounted within the core of the electromagnet, with the pole structure and the core being aligned and similarly oriented. Such air gaps are mutually spaced in the axial direction of movement of the rocking presser, so that the directions of the magnetic fields of the permanent magnet and the electromagnet within the first portion of the rocking presser are substantially perpendicular.

In a second form of the invention, the permanent magnet is mounted outside the core of the electromagnet with the pole structure and the core being aligned but oppositely oriented. The rocking presser is positioned intermediate the air gaps. If desired, both the rocking presser and the permanent magnet may be mounted on the periphery of the circular bed of the machine, while the electromagnet is situated in radially spaced relation to such periphery.

BRIEF DESCRIPTION OF THE DRAWING

The invention will be further set forth in connection with the following detailed description taken in conjunction with the appended drawing, in which.

DETAILED DESCRIPTION

Figure 1:
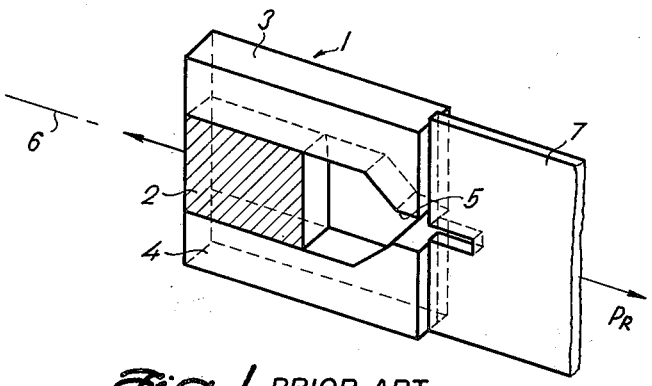
Fig. 1. PRIOR ART
FIG. 1 is a perspective view of a permanent magnet of the type used to keep the rocking presser of the circular knitting machine which has been moved close to the magnet with the help of a cam, in a non-knitting position against a restoring force.

As indicated above, the improved mounting means of the invention is useful primarily in the context of the magnetic rocking presser actuator for a circular knitting machine in which the magnetic fields of a normally unexcited electromagnet and a permanent magnet cooperate. The permanent magnet, together with a cam which moves the presser close to the permanent magnet and the restoring force caused by the flexibility of the jack, cooperate to selectively position the presser on the periphery of the machine between a knitting and a non-knitting position.

Since the structure and operation of the rotary needle cylinder of such machine and the manner in which the jacks thereon are selectively positioned by the actuator are well-known to those skilled in the art and form no part of the invention, they will not be described further except where specifically relevant.

The whole assembly, comprising the permanent magnet with pole shoes, the electromagnet with pole shoes and the coil, is embedded in artificial resin so that after hardening and taking out of the mold it constitutes a self-supporting assembly which is placed into the holders in cam blocks associated with the neddle cylinder. Such holders are not part of the invention. For simplicity of illustration the hardened resin of the assembly has been omitted in the various figures of the drawing.

The permanent magnet portion of an actuator of the type just described is shown in FIG. 1. The magnet, designated by the numeral 1, includes a central magnetic member 2 which interconnects a pair of elongated pole pieces 3 and 4 which converge at their forward ends to define a first air gap 5. The magnet 1 exerts an attractive force (designated Pm in FIG. 3) in an axial direction, represented by a line 6, on a jack or rocking presser 7 of magnetically reactive material which may be associated at its forward end (not shown)

with a suitable needle on the periphery of the above-mentioned circular knitting machine. The attractive force Pm acts against an oppositely directed axial force Pr which may represent the restoring force caused by the flexibility of the rocking presser which is suitably formed so that it may act as a spring. In normal operation the attractive force Pm is greater than the restoring force Pr so that the rocking presser 7, moved close to the permanent magnet by the help of a cam 18, is normally kept in this position being attracted by the magnet 1 in the absence of suitable constraints of the type described below.

In accordance with the first embodiment of the invention, the permanent magnet 1 is disposed within a separate, generally U-shaped core structure 8 (FIG. 2) of an electromagnet 9 to form the composite magnetic actuator designated generally by 10. The forward ends of the core 8 converge to define a relatively large second air gap 11 through which the rear end of the rocking presser 7 may reciprocate axially. The rear end of the air gap 11 and the front end of the air gap 5 are axially separated by a distance D. As shown, the core 8 and the pole structure 3 and 4 are similarly oriented with respect to the line 6. The respective outer surfaces of the pole structure 3 and 4 and the adjacent inner surfaces of the core 8 are each radially separated by a spacing T.

The electromagnet 9 further includes a coil 12 surrounding the rear end of the core 8. Terminals 12A of the coil 12 may be coupled to conventional driving circuitry (not shown) for the actuator.

The rear end of the rocking presser 7 is provided with a centrally located recess 13 coaxial with the air gaps 5 and 11. The recess 13 defines a third air gap within which the magnetic fields of the electromagnet and the permanent magnet intersect. In order to present impact between the rear end of the rocking presser 7 and the pole pieces 3 and 4, a standoff member 14 which may be made of a relatively hard material such as sapphire extends axially from the air gap 5 in a forward direction in alignment with the recess 13 to limit the rearward motion of the rocking presser 7. The length of the member 14 is chosen to maintain a spacing S between the forward end of the pole pieces 3 and 4 and the rear end of the rocking presser 7. It has been found advantageous to make the distance S less than the distance D between adjacent ends of the air gaps 5 and 11 in order to accelerate the movement of the rocking presser 7 in the forward direction when the force Pr exceeds the attraction force Pm, e.g., upon the excitation of the coil 12 as indicated below. If desired, the member 14 may be provided with a guiding surface for the recess 13 to help center the rocking presser 7 during reciprocation along the line 6.

Figure 7:
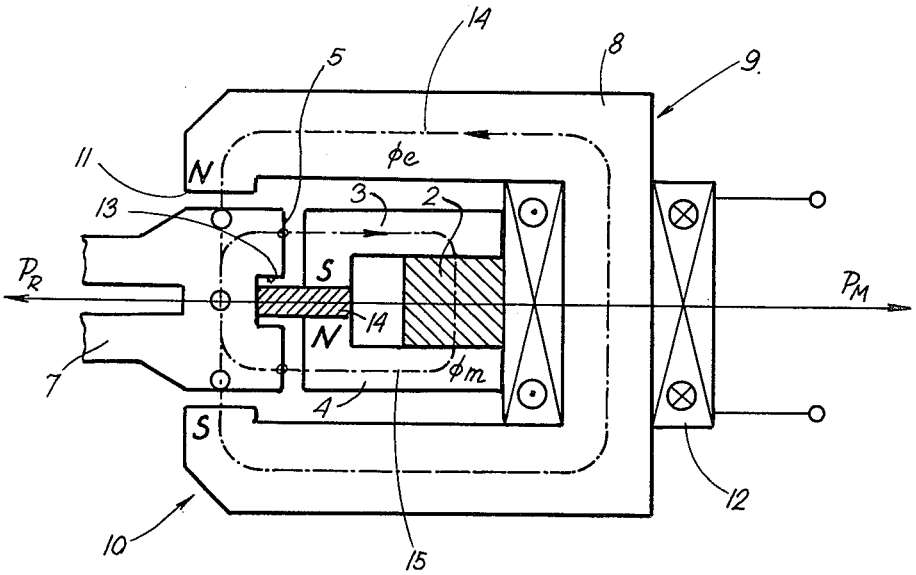
FIG. 7 is a view similar to FIG. 2 but showing the north and south poles of the permanent magnet and the electromagnet, and the magnetic fields of the two magnets.

It will be noted from the above description from FIG. 7 that the permanent magnet 1 and the electromagnet 9 of the magnetic actuator 10 are mutually disposed so that the magnetic fields established in each do not interfere with the magnetic structure of the other. The magnetic fields provided by each of such magnets intersect only within the rocking presser 7 and, in the arrangement shown in FIG. 7, are mutually perpendicular only in the region of intersection. Because the magnetic fields are perpendicular to each other only at every point where they enter into the controlling part of the knitting machine, the driving circuitry for the actuator operates at relatively high efficiency. In the region of encounter the two magnetic fluxes are, of course, parallel, but of opposite directions so that they compensate each other. This permits the driving circuitry for the actuator to operate at relatively high efficiency.

Figure 2:
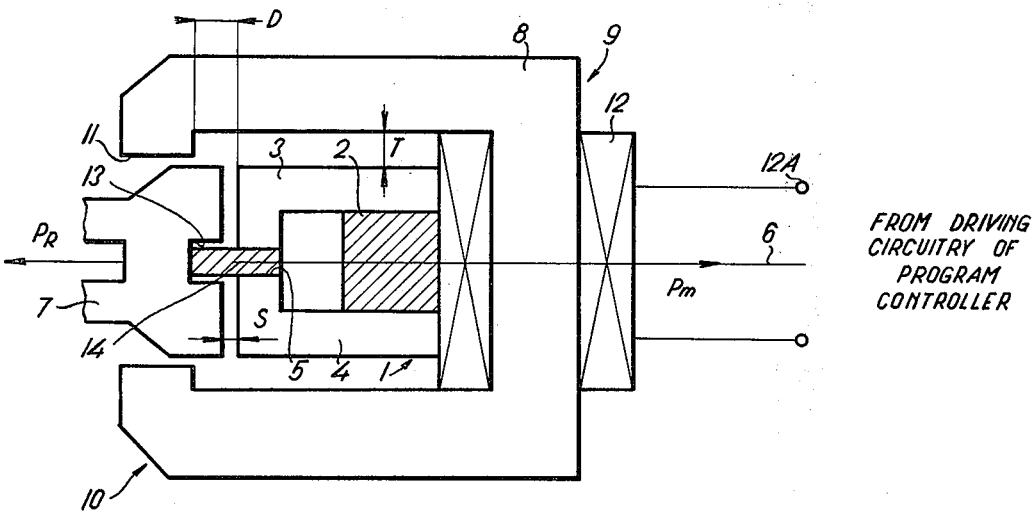
FIG. 2 is a diagram partially in side elevation and partially in section, of the first form of mounting arrangement in accordance with the invention for situating the pole structure of the permanent magnet of FIG. 1 within a separate core of a separate electromagnet.
Figure 3:
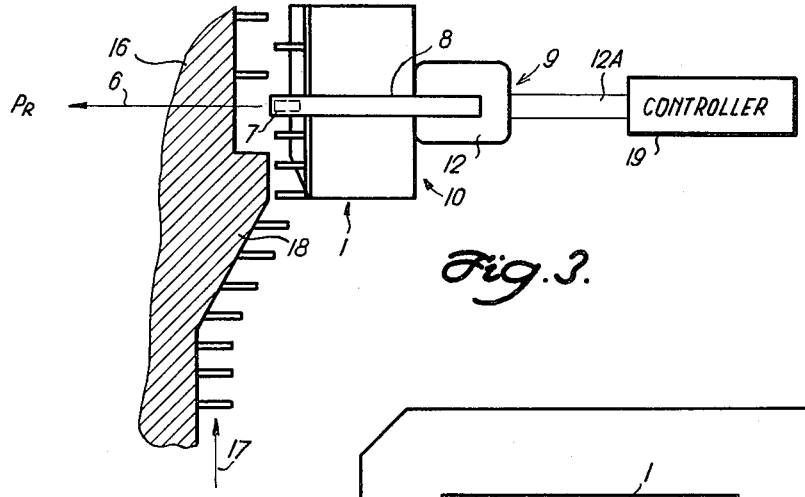
FIG. 3 is a diagrammatic view of a permanent magnet-electromagnet assembly constructed as in FIG. 2 and mounted opposite the periphery of a jack-carrying circular bed of the machine.
Figure 6:
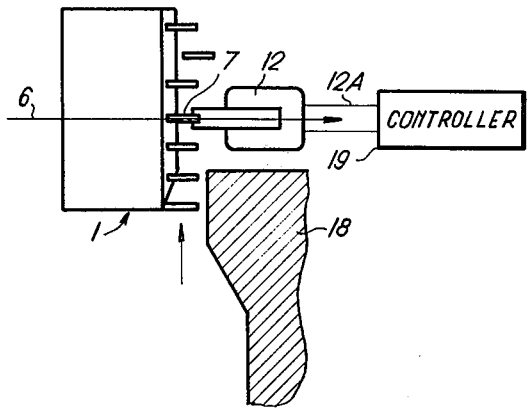
FIG. 6 is a diagrammatic view of a permanent magnet-electromagnet assembly constructed in a manner similar to FIG. 5 but with the permanent magnet and the jacks disposed on the moving circular bed of the machine and the electromagnet radially spaced from the periphery.

An actuator 10 of the type illustrated in FIG. 2 is shown in FIG. 3 and is disposed radially with respect to the periphery of a rotary needle cylinder bed of a circular knitting machine. It is assumed that the surface of the rotary needle bed with needles and rocking pressers move in the direction of an arrow 17 and that each successive rocking presser is urged by a cam section 18 toward the actuator 10. The rocking presser moves in the same track with the corresponding needle. The part 18, which is shown in FIGS. 3 and 6, is a part of a stationary cam, while the needles and the rocking pressers move with the rotary needle bed. A prior art machine which incorporates this cam and needle cylinder arrangement is disclosed in U.S. Pat. No. 3,771,332 co-assigned to the assignee of the present application.

While the coil 12 remains deenergized, each rocking presser 7 is attracted toward the permanent magnet 1. As the rocking presser reaches the position defined by the line 6, a knit or no-knit decision is made by a suitable program controller 19. If a knit command is outpulsed from the controller 19, the coil 12 will remain unexcitec and the rocking presser will remain attracted to the permanent magnet 1. On the other hand, if a no-knit command is outpulsed from the controller 19, the coil 12 will be excited and the resulting magnetic force in the core 8 will tend to displace the attractive force of the magnet 1 on the rocking presser thereby effectively weakening the attractive force and permitting the restoring force Pr to move the associated rocking presser through the air gap 11 (FIG. 2) in the forward direction into engagement with the periphery of the bed 16 (FIG. 3) to establish the knitting position for the rocking presser. In this embodiment it is to be understood that, as set forth above the force Pr is caused by the springiness of the rocking presser.

Figure 4:
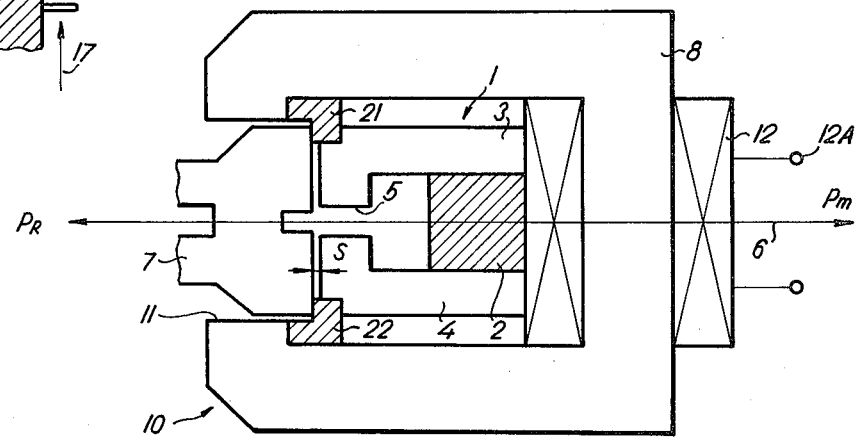
FIG. 4 is a diagram similar to FIG. 2, illustrating an alternative means for establishing a minimum separation of the jack from the pole structure of the permanent magnet.

FIG. 4 shows a modification of the actuator 10 of FIG. 2 wherein the standoff member of the latter is replaced by a pair of spacers or shims 21 and 22 of hard, non-magnetic material such as sapphire to maintain the desired separation S between the rear end of the rocking presser and the forward end of the permanent magnet 1. The members 21 and 22 extend axially from the rearward end of the air gap 11 to a point near the forward end of the air gap 5, and radially from respectively opposite inner surfaces of the core 8 to points near the outer periphery of the pole structures 3 and 4 of the permanent magnet 1. The spacers 21 and 22 coaxially situate the first and second air gaps with respect to the direction of movement of the presser and space the air gaps in such direction. It will be appreciated that the function of the members 21 and 22 in establishing the spacing S is essentially identical to that of the member 14 of FIG. 2.

It will be understood that the shims 21 and 22 constitute a. means isolating the core of the electromagnet from the poles of the permanent magnet and b. means disposing the core of the electromagnet symmetrically with respect to the permanent magnet. Their shape has been chosen so as to provide guidance for the controlled ferromagnetic part and at the same time they protect the surface of the pole shoes and of the core of the electromagnet.

Figure 5:
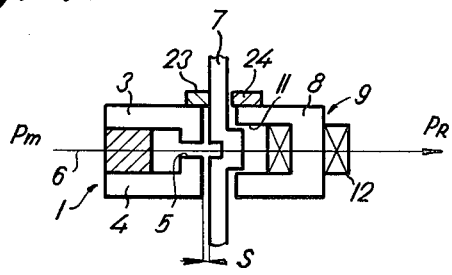
FIG. 5 is a diagram of a second form of mounting arrangement in accordance with the invention, in which the pole structure of the permanent magnet is disposed outside the core of the electromagnet.

Another form of actuator construction in accordance with the invention is shown in FIG. 5. In this scheme the permanent magnet 1, instead of being disposed within the core 8 as contemplated above, is located outside the core 8. In particular, the air gaps 5 and 11 are each coaxial with the line 6 and are axially aligned to face each other. In this case the jack 7 is supported intermediate the adjacent ends of the respective air gaps 5 and 11. In order to prevent impact between the rocking presser 7 and the adjacent walls of the air gaps 5 and 11, the structure of FIG. 5 is further provided with a pair of standoff members 23 and 24 made from a hard material, such as sapphire. The members 23 and 24 individually extend axially toward each other and overlap the associated air gaps 5 and 11. For this purpose the members 23 and 24 are mounted on corresponding outer surfaces of the permanent magnet 1 and the electromagnet 9. As in the previously described embodiments, the length of the members 23 and 24 may be chosen to maintain a minimum spacing S of the rocking presser 7 from the adjacent magnetic structure on each side. In FIG. 7 the flux path of the electromagnet is designated 14, and the flux path of the permanent magnet is designated 15. The flux strengths of such magnets are designated $Qe$ and $Qm$, respectively.

FIG. 6 shows an actuator of the general type depicted in FIG. 5 wherein both the permanent magnet 1 and the rocking pressers are located on the periphery of the moving circular bed of the knitting machine. The electromagnet is disposed radially spaced outwardly from the periphery of the circular bed and is mounted on fixed structure (not shown). In this arrangement, the permanent magnet 1 normally keeps each successive rocking presser 7 attracted to the periphery of the machine bed (not shown). When a knit command signal is outpulsed from the controller 19, the coil 12 of the electromagnet is actuated to move the associated rocking presser in a radially outward direction from the periphery to establish the knitting position. In other respects, the arrangement of FIG. 6 functions in a manner similar to that of FIG. 3.

In each of the embodiments described above, the recessed area 13 (FIG. 2) of the rocking presser 7 tends to concentrate the lines of flux passing through the rocking presser from the magnetic circuits of both the permanent magnet and the electromagnet, thereby further lowering the effective reluctance of the magnetic circuit of the actuator and thereby further reducing the load on the driving circuitry.

It will be understood from the above that in the cross section of the controlled element marked 7 (FIG. 4) both magnetic fluxes — i.e. the magnetic flux excited by the permanent magnet and the magnetic flux excited by the electromagnet — are parallel to each other, but of opposite directions, so that the flux excited by the permanent magnet is weakened. This results in a weakening of the flux in the air gap between the controlled element and the pole shoes of the permanent magnet and consequently the attractive force $P_m$ between the controlled element 7 and the pole shoes of the permanent magnet is reduced. When this attractive force $P_m$ decreases so much that the directive force $P_r$ affecting the controlled element prevails, the controlled element 7 falls off the pole shoes of the permanent magnet with subsequent selection effect.

The magnetic flux of the driving circuit enters the controlled element perpendicular to the direction of the movement of the element from the shoes of the permanent magnet. This magnetic flux therefore does not affect the directive force which tends to separate the controlled element from the surface of the pole shoes of the permanent magnet. To the contrary, by a suitable shape of the controlled element (see the chamfering in FIG. 2) its falling off the pole shoes can be speeded up.

It will be understood that the above-described embodiments are merely illustrative of the principles of the invention. Numerous other variations and modifications will now occur to those skilled in the art. Accordingly, it is desired that the scope of the appended claims not be limited to the specific disclosure herein contained.

What is claimed is:

1. In a circular knitting machine having a plurality of knitting elements, each of said elements having at least one ferromagnetic component, the improvement which comprises apparatus for the individual control of any of the knitting elements, the apparatus comprising at least one selector unit which contains a permanent magnet and pole pieces connected therewith, and an electromagnetic unit including an electromagnet and a coil connected therewith, the permanent magnet and its pole pieces, and the electromagnet and its coil being so shaped and arranged with regard to each other and with respect to ferromagnetic component of the knitting elements that they form two substantially separate magnetic circuits whose magnetic fluxes pass parallelly and opposite through a substantial portion of the cross-section of the controlled ferromagnetic component except for the portion associated with the input direction of said magnetic fluxes into said ferromagnetic component wherein said fluxes are substantially perpendicular to each other.

2. A circular knitting machine comprising a permanent magnet and a rotatable needle bed with the flux path of said permanent magnet positioned symmetrically about a first axis, a magnetically actuable rocking presser through which the flux of the permanent magnet passes to exert an attractive force on the rocking presser along the first axis, means including a stationary cam for moving the rocking presser to the permanent magnet, the permanent magnet attracting the rocker presser into a first position against a restoring force, a normally deenergized electromagnet which when energized weakens the force exerted by the permanent magnet on the rocking presser so that the restoring force moves the rocking presser away from the permanent magnet in the direction of the first axis and into a released position in the periphery of the needle bed, the permanent magnet having poles separated by a first air gap, the electromagnet having a core with poles separated by a second air gap, means isolating the core of the electromagnet from the poles of the permanent magnet so that the flux path established through the core of the electromagnet when the latter is energized does not substantially affect the flux path of the permanent magnet, said last named means disposing the core of the electromagnet symmetrically with respect to the permanent magnet, and the core of the electromagnet being positioned axially relative to said first axis so that the input direction of the flux path of the electromagnet is disposed substantially perpendicular to the input direction of the flux path of the permanent magnet in the rocking presser when the latter electromagnet is energized after which said fluxes are substantially parallel and opposite to each other when passing through a substantial portion of the rocking presser so as to weaken the portion of the flux of the permanent magnet that attracts the rocking presser when the rocking presser is in its said first position.

3. A machine as defined in claim 2, wherein the first and second air gaps are disposed coaxially with respect to the direction of movement of the rocking presser and for spacing such air gaps in such direction, the rocking presser having a recess defining a third air gap within which the magnetic fields of the electromagnet and the permanent magnet intersect.

4. A machine as defined in claim 3, in which the core of the electromagnet is U-shaped and has spaced arms and the permanent magnet is disposed between the arms of the core of the electromagnet with the pole structures and of the two magnets aligned relative to each other.

5. A machine as defined in claim 4, wherein said isolating means include standoff means for preventing impact between the rocking presser and the pole pieces of the permanent magnet while the electromagnet remains unenergized, the axial length of the standoff means being chosen to establish the minimum axial distance between the rocking presser and the first air gap at a value less than the axial spacing between the first and the second air gaps.

6. A machine as defined in claim 5, in which the standoff means comprises an element extending axially from the first air gap of the permanent magnet and engageable with the recess of the rocking presser.

7. A machine as defined in claim 5, in which the standoff means comprises a pair of spacers extending axially between the first and second air gaps and radially between opposite outer surfaces of the permanent magnet and respectively adjacent inner surfaces of the electromagnet.

8. A machine as defined in claim 4, in which the machine has a rotatable circular bed on the periphery of which the rocking pressers are disposed, and the permanent magnet and the electromagnet are disposed in radially spaced relation to the periphery.

9. The machine as defined in claim 2, in which the permanent magnet has a pole structure, the electromagnet has a core, and the pole structure is mounted outside the core of the electromagnet, the pole structure and the core being axially aligned, the flux of the electromagnet being oriented oppositely from the flux of the permanent magnet.

10. A machine as defined in claim 9, further comprising standoff means for preventing impact between the rocking presser and the pole structure of the permanent magnet while the electromagnet remains unexcited, the axial length of the standoff means being chosen to establish the minimum axial distance between the rocking presser and the first air gap at a value less than the spacing between the first and the second air gaps.

11. A machine as defined in claim 9, in which the machine further comprises a rotary needle cylinder on the periphery of which the rocking pressers are disposed, and wherein the permanent magnet and the electromagnet are disposed outwardly the periphery of the needle cylinder in radially spaced relation with respect thereto.

* * * * *